US007918262B2

(12) United States Patent
Chiu

(10) Patent No.: US 7,918,262 B2
(45) Date of Patent: Apr. 5, 2011

(54) TAPE CUTTING DISPENSER

(75) Inventor: Tzu-Chin Chiu, Changhua County (TW)

(73) Assignee: Caimon Enterprise Co., Ltd., Yuanlin Town, Changhua County (TW)

( * ) Notice: Subject to any disclaimer, the term of this patent is extended or adjusted under 35 U.S.C. 154(b) by 171 days.

(21) Appl. No.: 12/273,161

(22) Filed: Nov. 18, 2008

(65) Prior Publication Data

US 2010/0122776 A1 May 20, 2010

(51) Int. Cl.
*B32B 37/00* (2006.01)
*B65H 35/07* (2006.01)

(52) U.S. Cl. ..... 156/510; 156/579; 225/47; 225/65; 225/77

(58) Field of Classification Search ..... 225/47, 225/56, 65, 77; 206/441; 242/160.1, 160.4, 242/129.51, 578; 156/527, 579, 577, 510
See application file for complete search history.

(56) References Cited

U.S. PATENT DOCUMENTS

| | | | | |
|---|---|---|---|---|
| 1,217,211 | A * | 2/1917 | Pico | 242/596.4 |
| 2,555,885 | A * | 6/1951 | Hope | 242/596.4 |
| 3,156,425 | A * | 11/1964 | Mynchenberg | 242/590 |
| 4,957,233 | A | 9/1990 | Samuelson | |
| 5,535,955 | A | 7/1996 | Enger et al. | |
| 6,092,758 | A | 7/2000 | Gemmell | |
| 2003/0146339 | A1 | 8/2003 | Liu | |

FOREIGN PATENT DOCUMENTS

| | | |
|---|---|---|
| TW | 00383752 | 3/2000 |

* cited by examiner

*Primary Examiner* — Linda L Gray
(74) *Attorney, Agent, or Firm* — Muncy, Geissler, Olds & Lowe, PLLC

(57) ABSTRACT

The present invention provides a tape cutting dispenser comprising a body, a pair of a holders and a cutting device. The body has two opposite walls, each of the walls has a hole and an accommodating space is formed between the two walls. The holder is disposed in the hole. Each of the holders has a protruding portion protruding toward the wall along an axial direction and further has an elastic element. The elastic element has axial flexibility and the elasticity bending away from the axial direction, such that the protruding portion of the holder is recoverably bendable away from the axial direction. The cutting device is disposed on the body opposite to the accommodating space.

14 Claims, 10 Drawing Sheets

TAPE CUTTING DISPENSER

BACKGROUND OF THE INVENTION

1. Field of the Invention

The present invention relates to a tape dispenser, and more particularly the present invention relates to a tape cutting dispenser which has a holder recoverably bending away from an axial direction.

2. Description of the Prior Art

Tapes have become an indispensable product in modern life, for use at home, office, medical treatment or factory, etc. However, in order to use the tapes and cut the tape more convenient, therefore, the tape dispenser is invented.

As FIG. 1 shows, the conventional tape dispenser includes a dispenser body 10, a roller 12 and a cutting blade 14. The dispenser body 10 has a taping trough 16 for accommodating the tape 70. The two side walls of the roller 12 have a protruding shaft 20 while the two sides of the taping trough 16 has a gap 18 for positioning the shaft 20 of the roller 12. When pulling the tape 70 toward the cutting blade 14, the cutting blade 14 will cut the tape in a demanded position.

To replace the tape 70, the roller 12 is took off from the taping trough 16, a ring core 72 of the tape 70 engages with the outer circumference of the roller 12, and then the shaft 20 is put into the gap 18 of the taping trough 16 to finish the replacement of the new tape 70.

After the conventional tape dispenser is used for a period of time, the shaft 20 of the roller 12 may be broken, even the whole roller 12 may be missing. As a result, a user must buy a new roller 12 to maintain the tape disperser as useable. The present invention is provided to improve the aforesaid problems and achieve other objectives as follows.

SUMMARY OF THE INVENTION

It is an objective of the present invention to provide a tape cutting dispenser with a simplified and easily assembled structure.

It is another objective of the present invention to provide a tape cutting dispenser that can be used with several different sizes/dimensions of tape.

It is another objective of the present invention to provide a tape cutting dispenser for quickly replacing and/or positioning a tape.

The present invention provides a tape cutting dispenser comprising a body, a pair of a holders and a cutting device. The body has two opposite walls, each of the walls has a hole and an accommodating space is formed between the two walls. The holder is disposed in the hole. Each of the holders has a protruding portion protruding toward the wall along an axial direction and further has an elastic element. The elastic element has axial flexibility and the elasticity bending away from the axial direction, such that the protruding portion of the holder is recoverably bendable away from the axial direction. The cutting device is disposed on the body opposite to the accommodating space.

In the preferable embodiment further includes at least one cover that provides to cover the outside surface of the hole of the wall. The cover has at least one female connecting portion while the inner circumference of the hole has at least one male connecting portion engages with the female connecting portion. In addition, the inner axial center of the holder has a first positioning pillar for engaging with one end of the elastic element; the inner surface of the cover has a second positioning pillar corresponding to the first positioning pillar for engaging with the other end of the elastic element. The holder has at least one guiding portion extending out of a rim of the holder while the hole of the wall has at least one guiding groove to receive the guiding portion.

In the other preferred embodiment, the holder may be replaced with a holder module. In other words, the holder module includes a holder and the fastening sleeve, the holder is axially moveable along the fastening sleeve. The side wall of the fastening sleeve further forms at least one aperture while the wall has at least one hook engaging with the aperture. In addition, one side of the fastening sleeve and the cover are preferably integrately formed to cover the outside surface of the hole of the wall.

DETAILED DESCRIPTION OF THE PREFERRED EMBODIMENT

The present invention provides a tape cutting dispenser with a simplified and easily assembled structure. In the preferred embodiment, the tape cutting dispenser is provided for using with stationery tapes, and its used field such as school, office or other relative places. The dimension (width of the tape) of the stationery tape includes, but not limit to, ½, ¾ and 1 inch. In other embodiments, however, the tape cutting dispenser may apply not only to stationery tape, but also to the usage at home, medical treatment or commercially factory. In order to illustrate the present invention, various embodiments and structures thereof are described below and are accompanied with drawings.

Figure 1:
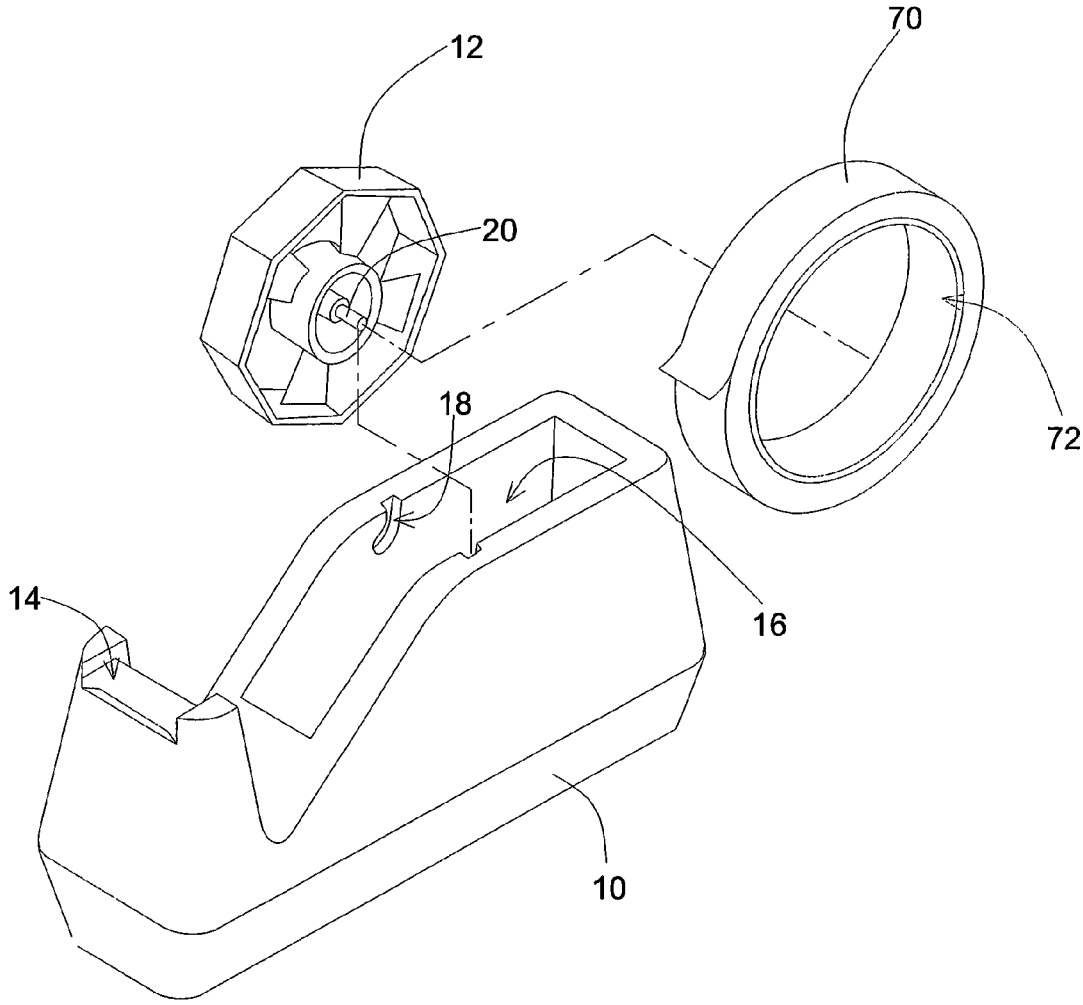
Fig. 1 (PRIOR ART)
FIG. 1 shows an exploded view of a conventional tape dispenser.
Figure 2A:
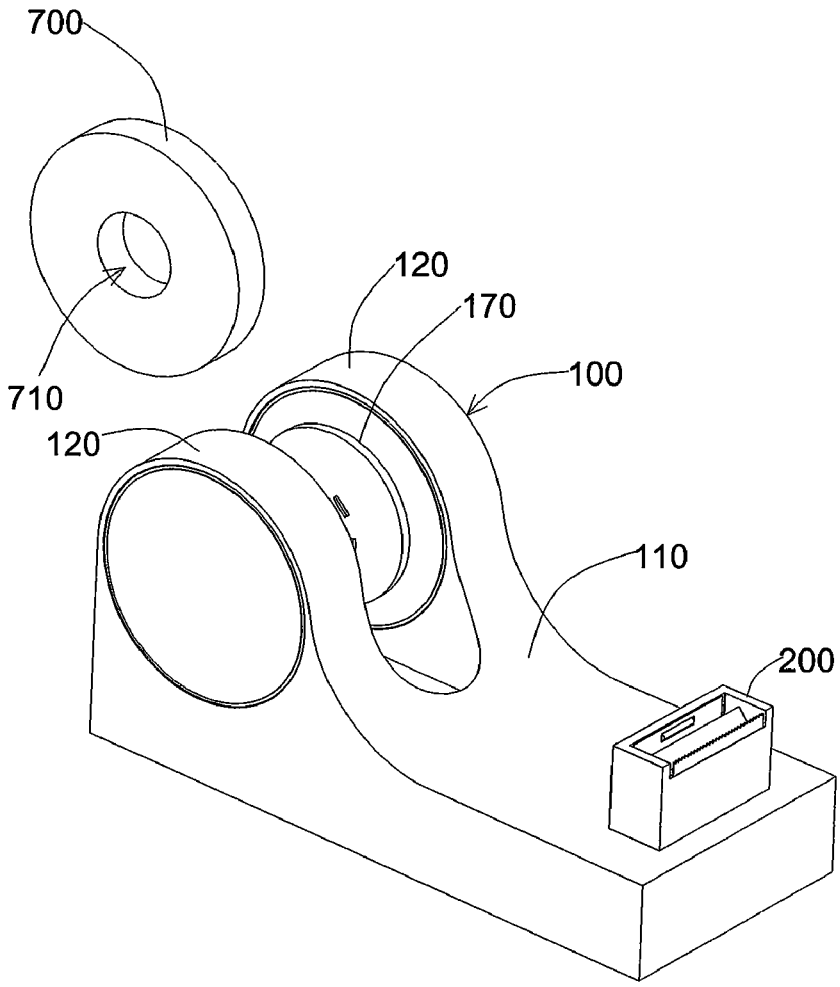
FIG. 2*a* shows a first embodiment of the present invention of the tape cutting dispenser.
Figure 2B:
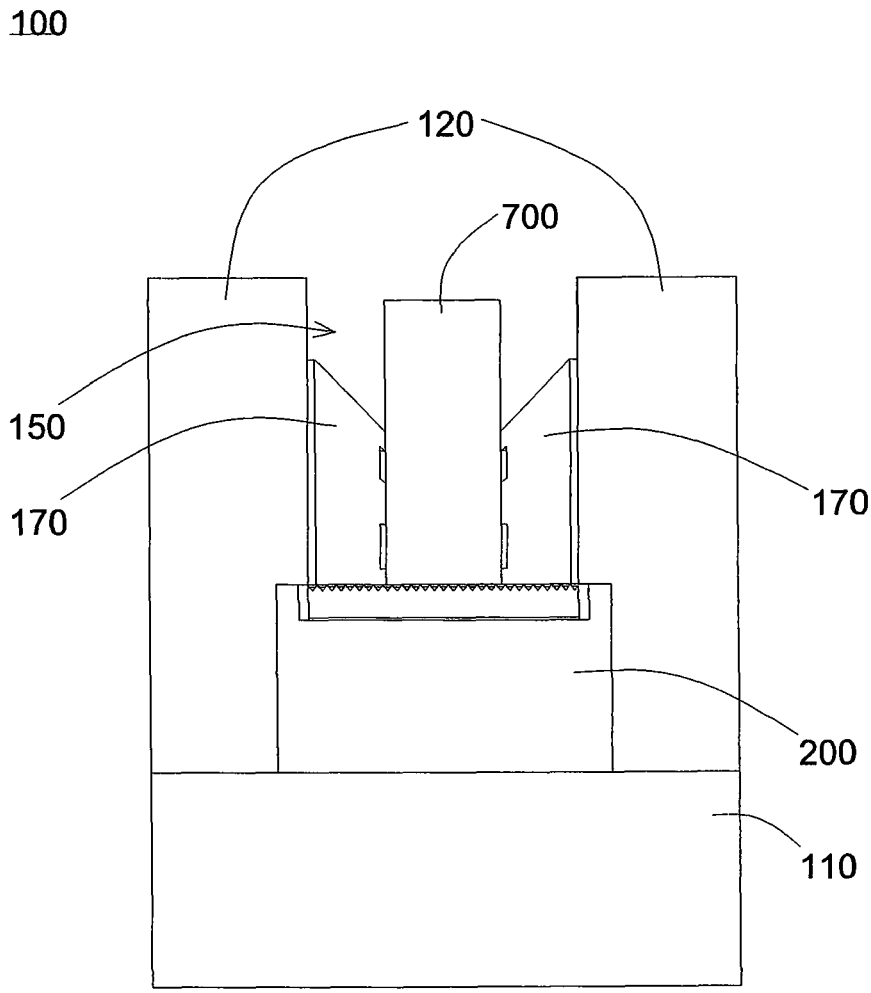
FIG. 2*b* shows a front view of the present invention of the tape cutting dispenser.
Figure 3:
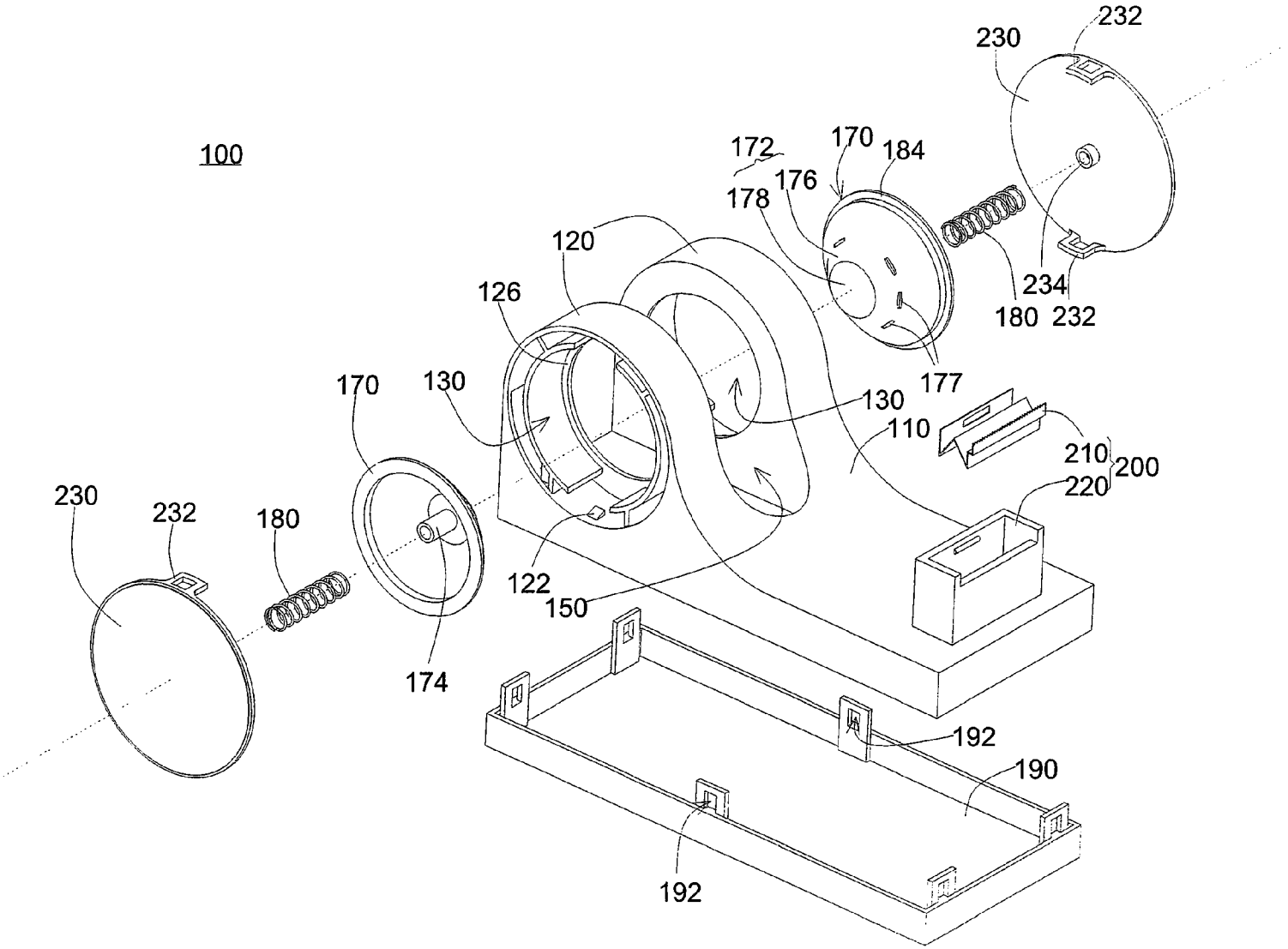
FIG. 3 shows an exploded view of the present invention of the tape cutting dispenser.

As FIGS. 2*a*, 2*b* and 3 show, the present invention of the tape cutting dispenser 100 includes a body 110, a pair of holders 170 and a cutting device 200. The body 110 has two opposite walls 120, and each of the walls 120 has a hole 130 and an accommodating space 150 is formed between the two walls 130. In the present embodiment, the accommodating space 150 preferably is formed between the two walls 120, such that each of the walls 120 of the body 110 is not connected to each other. In other different embodiments, however, the wall 120 of the body 110 may be connected to each other to enclose the accommodating apace 150 (not illustrated). Two holders 170 are disposed within each of the holes 130 and restrictably moveable in the hole 130. The holder 170 has a protruding portion 172 for engaging with the ring core 710 of the tape 700.

In the embodiment shown in FIG. 3, the protruding portion 172 of the holder 170 preferably includes a cone casing 176, a top surface 178 and a flange 184, wherein the top surface 178 is located on the top end of the cone casing 176, and the flange 184 is disposed on the bottom end of the cone casing 176. In other embodiments, however, the protruding portion 172 may also be constructed of an arc-curved surface or/and other proper shapes. In the embodiment shown in FIG. 2*b* and 3, the surface of the protruding portion 172 (i.e. the corn casing 176) preferably has a plurality of dents 177, at least one of the surfaces of the dents 177 is disposed parallel to the top surface 178 for fixing the ring core 710 of the tape 700 to prevent the tape 700 from moves along the cone surface of the corn casing 176 (as FIG. 2*b* shown). The diameter of the top surface 178 is smaller than the diameter of the ring core 710 such that the ring core 710 of the tape 700 can pass through and engage with the corn casing 176.

In addition, in the embodiment shown in FIG. 3, the present embodiment further includes two covers 230 to cover the outside surface of the hole 130 of the wall 120. In other embodiments, however, the cover 230 and the outside surface of the wall 120 may also be integrately formed. Thus, when the holder 170 assembles in the hole 130 of the wall 120, the holder 170 has to assemble from inside (i.e., from the space between the two walls 120). The cover 230 preferably has at least one female connecting portion 232 extending out of a rim of the holder 170 while the wall 120 around the hole 130 has a male connecting portion 122 for engaging with the female connecting portion 232. The above-mentioned of the female connecting portion 232 is preferably being a side border which has an opening, and the male connecting portion 122 is preferably being a protrusion, such that the protrusion is capable of engaging with the side border. In another embodiment, however, the arrangement of the female connecting portion 232 and the male connecting portion 122 may be reversed or use other proper elements, such as hook-loop, Velcro tape, fastening tape, etc.

The cutting device 200 is disposed on the body 110 opposite to the accommodating space 150. The cutting device 200 includes a cutting blade 210 and a bladed seat 220, wherein the cutting blade 220 is disposed on the bladed seat 220. A user may pull out the tape 700 and then take an appropriate length of the tape to cut it off on the cutting device 200. Moreover, the tape cutting dispenser 100 further has a base 190 for assembling beneath the body 110. A plurality of clips 192 are disposed on the top edge of the base 190 for engaging with the fasteners (not illustrated in the drawings) which are disposed corresponding to the clips 192. In another embodiment, however, the base 190 and the body 110 may also be integrately formed.

Figure 4:
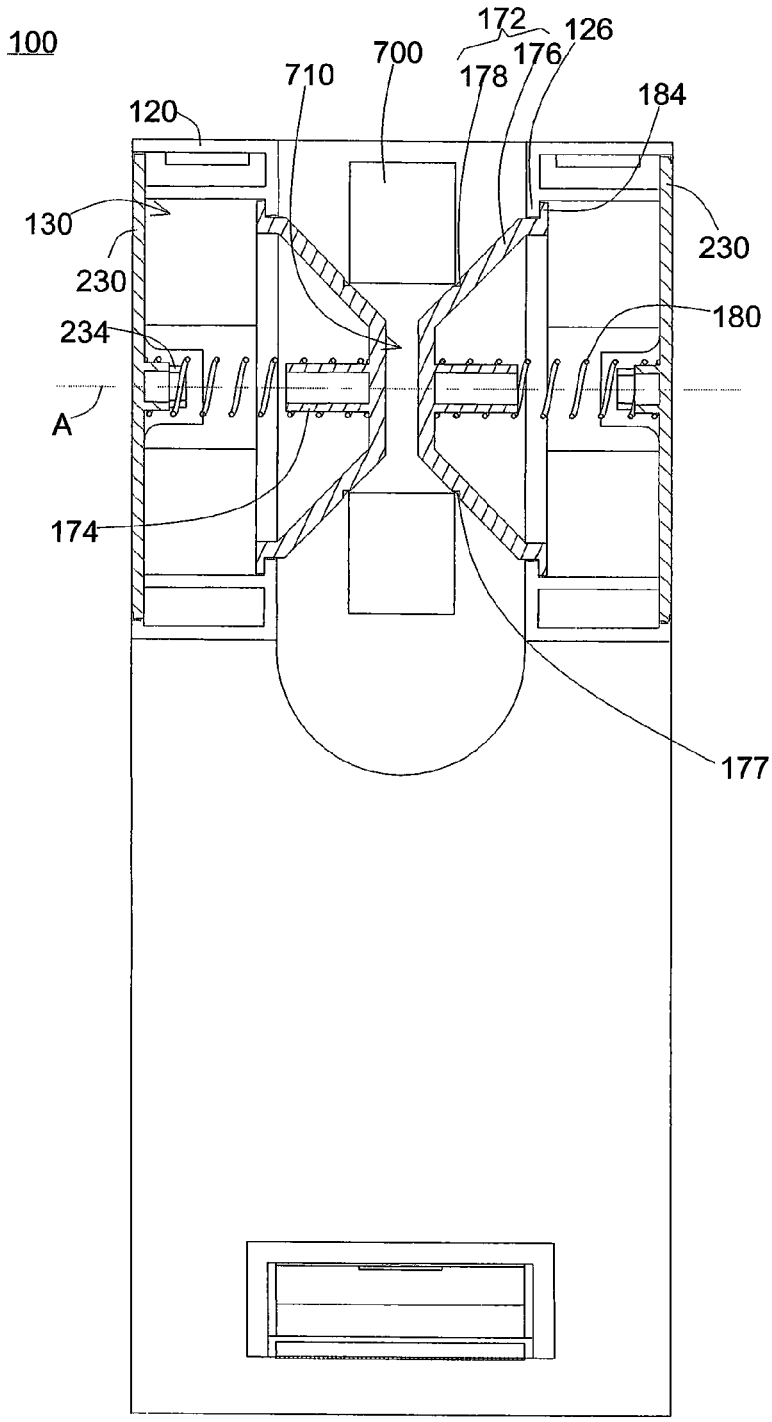
FIG. 4 shows a cross-sectional view of the present invention to assemble a tape.

Please also refer to FIG. 4, each of the protruding portions 172 of the holders 170 protrudes toward the opposite wall 120 along an axial direction A. The holder 170 further has an elastic element 180. In the preferred embodiment, inner center of the holder 170 has a first positioning pillar 174 of the axial direction A for engaging with one end of the elastic element 180; inner surface of the cover 230 has the second position pillar 234 corresponding to the first positioning pillar 174 so as to engage with the other end of the elastic element 180. In another embodiment, however, the inner surface of the cover 230 may also be disposed without the second positioning pillar 234, the end of the elastic element 180 may simply contact with the inner surface of the cover 230 without further engagement. The first positioning pillar 174 and the second positioning pillar 234 mentioned-above are preferably a cylinder, and their diameter are smaller than the diameter of the elastic element 180. In other embodiments, however, the first positioning pillar 174 and the second positioning pillar 234 may also be a trough (not illustrated) for receiving the two ends of the elastic element 180. In addition, the elastic element 180 is preferably a spiral compression spring. In other embodiments, however, the elastic element 180 may also be an extension spring, a torsion spring or other proper springs.

Moreover, one side of the wall 120 around the hole 130 is preferably having a limiting portion 126 corresponding to the flange 184 for restricting the movement of the holder 170 along the axial direction A. In other words, when no external force is exerted to the elastic element 180, the flange 184 of the holder 170 will contact and restrict by the limiting portion 126 of the wall 120 due to the extensibility of the elastic element 180. At the same time, the two top surfaces 178 of the holder 170 preferably do not contact with each other.

Figure 5B:
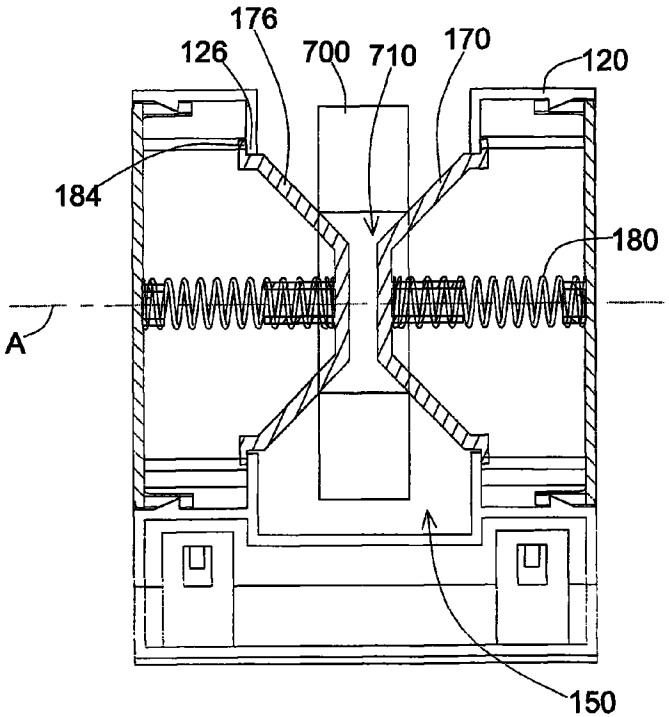
FIG. 5*b* shows a final operation view of the present invention to assemble the tape.
Figure 5A:
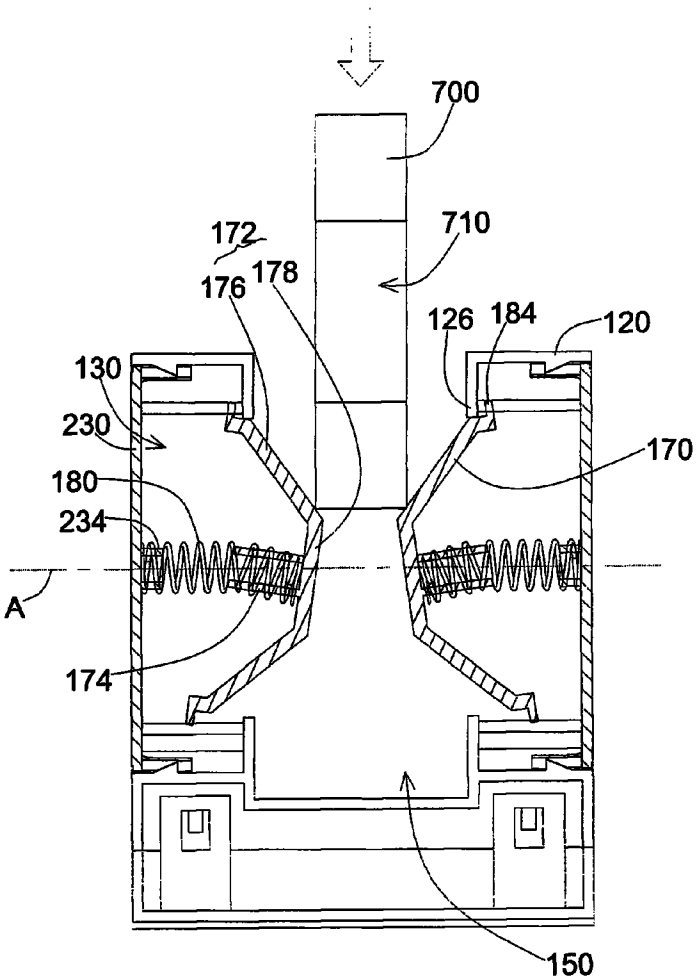
FIG. 5*a* shows an operation view of the present invention to assemble the tape.

In order to further illustrate the present invention, relating steps and various embodiments thereof are described below. As FIGS. 5*a* and 5*b* shows, when the tape 700 is inserted into the tape cutting disperser 100, the tape 700 contacts with the protruding portion 172 of the holder 170, such that the holder 170 is forced to bend downwardly and away from the axial direction A. In this stage, the elastic element 180 disposed inside the holder 170 will be axially compressed after receiving the external force and bend away from the axial direction A. The limiting portion 126 in association with the flange 184 of the holder 170 to confine the holder 170 within the hole 130 of the wall 120. Therefore, when the tape 700 pushes the holder 170 downwards, the elastic element 180 will be axial compressed and downwardly bend away from the axial direction A simultaneously until the ring core 710 of the tape 700 engages and positions on the protruding portion 710 of the holder 170. Afterwards, a rebound elastic force of the elastic element 180, recovers the holder 170 back to its original length and position.

Figure 6B:
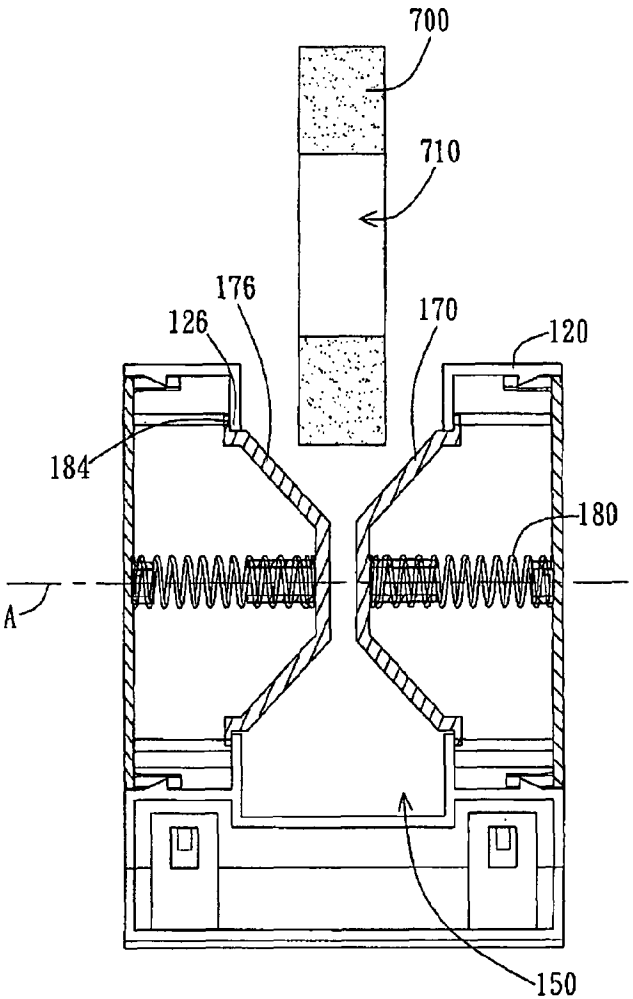
FIG. 6*b* shows a final operation view of the present invention to disassemble the tape.
Figure 6A:
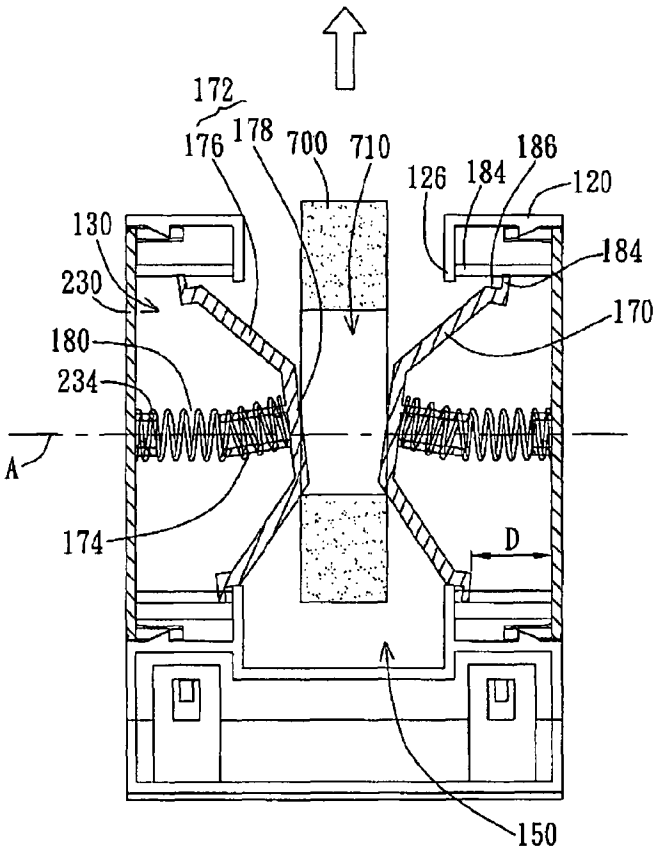
FIG. 6*a* shows an operation view of the present invention to disassemble the tape.

FIGS. 6*a* and 6*b* illustrate the disassembling of the tape and the tape cutting dispenser. When the tape 700 pulls the holder 170 upwards, the elastic element 180 disposed inside the holder 170 will be axially compressed and bent upwards away from the axial direction A. As shown in the present embodiment mentioned-above, the holder 170 is confined within the hole 130 by means of the limiting portion 126 of the hole 130. After the tape 700 entirely disengages from the holder 170, the elastic element 180 recovers the holder 170 back to its original length and position. Therefore, even though the size of the tape 700 changes, when replacing the tape 700, the holder 170 may move inside the hole 130 and then rebound quickly by means of the elasticity of the elastic element 180. In the embodiment shown in FIG. 6*a*, a sidewall 186 is further disposed between the cone casing 176 and the flange 184 and the sidewall 186 is preferably around the axial direction A. The elastic element 180 allows the protruding portion 172 to move backward within the distance of stroke D. The stroke D of the elastic element 180 is preferably greater than the depth of the sidewall 186, thus the holder 170 may be recoverably bended away from the axial direction A.

Figure 7:
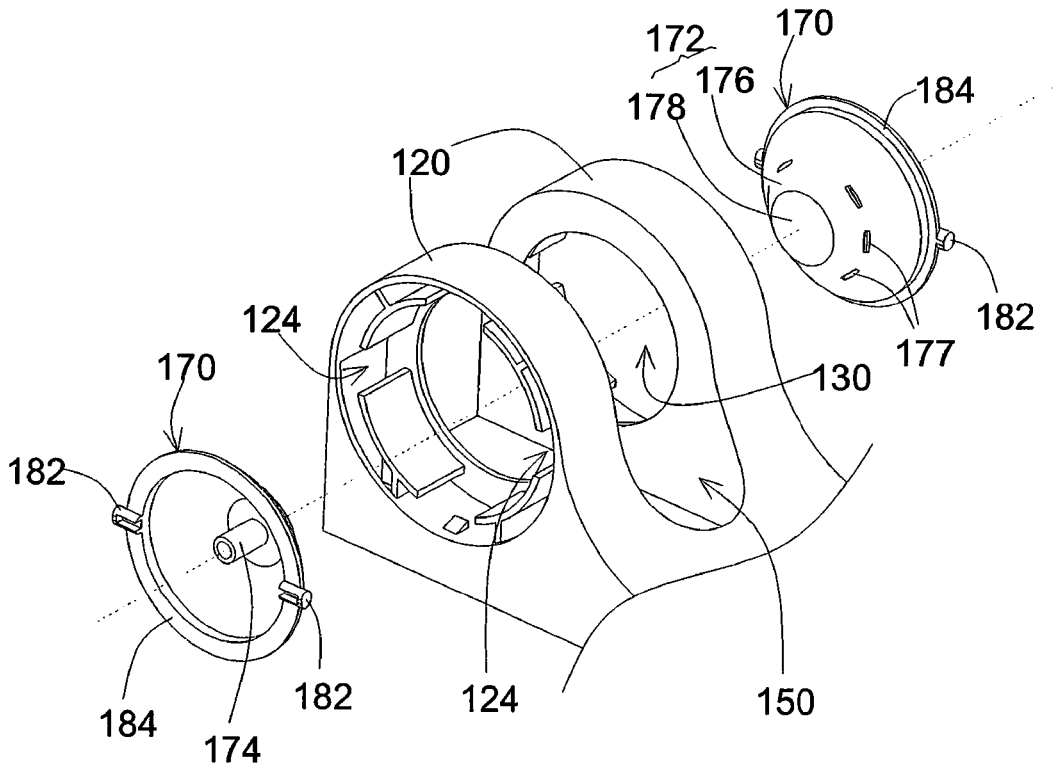
FIG. 7 shows another embodiment of the holder assembling the hole according to the present invention.

In order to increase the stability of bending motion away from the axial direction A of the holder 170, the holder 170 further has at least one guiding portion 182 disposed on the rim of the flange 184, as FIG. 7 shown. At least one guiding groove 124 corresponding to the guiding portion 182 is disposed on the wall 120 which enclosing the hole 130 for guiding the guiding portion 182. In the embodiment shown in FIG. 7, the width of the guiding groove 124 is greater than the width of the guiding portion 182, such that the holder 170 can be bent appropriate ranges/angles. When assembling or disassembling the tape with the tape cutting dispenser, the bending ranges/angles away the axial direction A of the holder 170 will be limited to the guiding groove 124, thus, unnecessary interference between the flange 184 and the side wall of the hole 130 can be avoided, and allow the holder 170 to return to its original position/status.

Figure 8A:
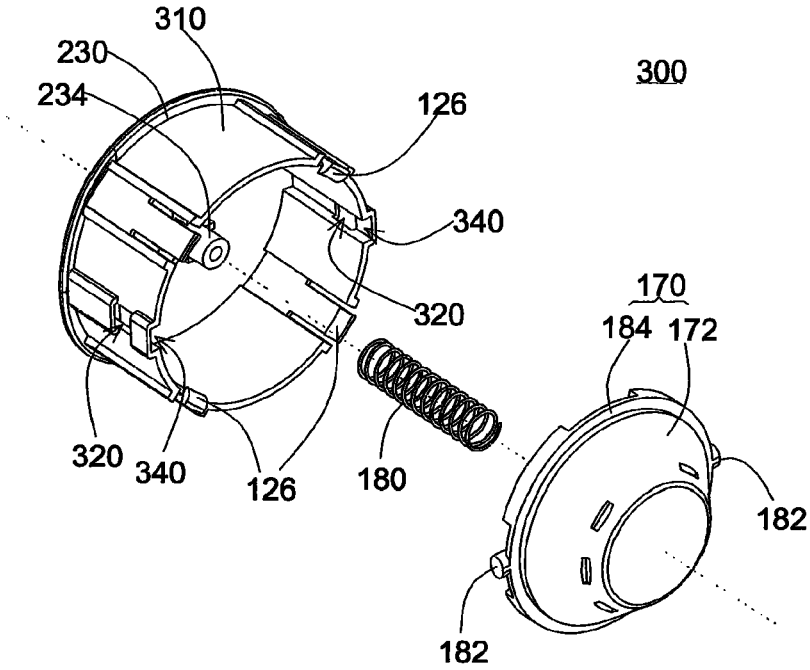
FIG. 8*a* shows an exploded view of the holder module of the present invention.
Figure 8B:
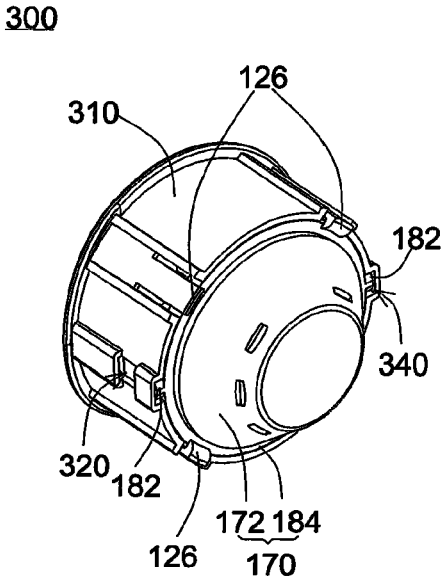
FIG. 8*b* shows an assembling view of the holder module of the present invention.
Figure 9:
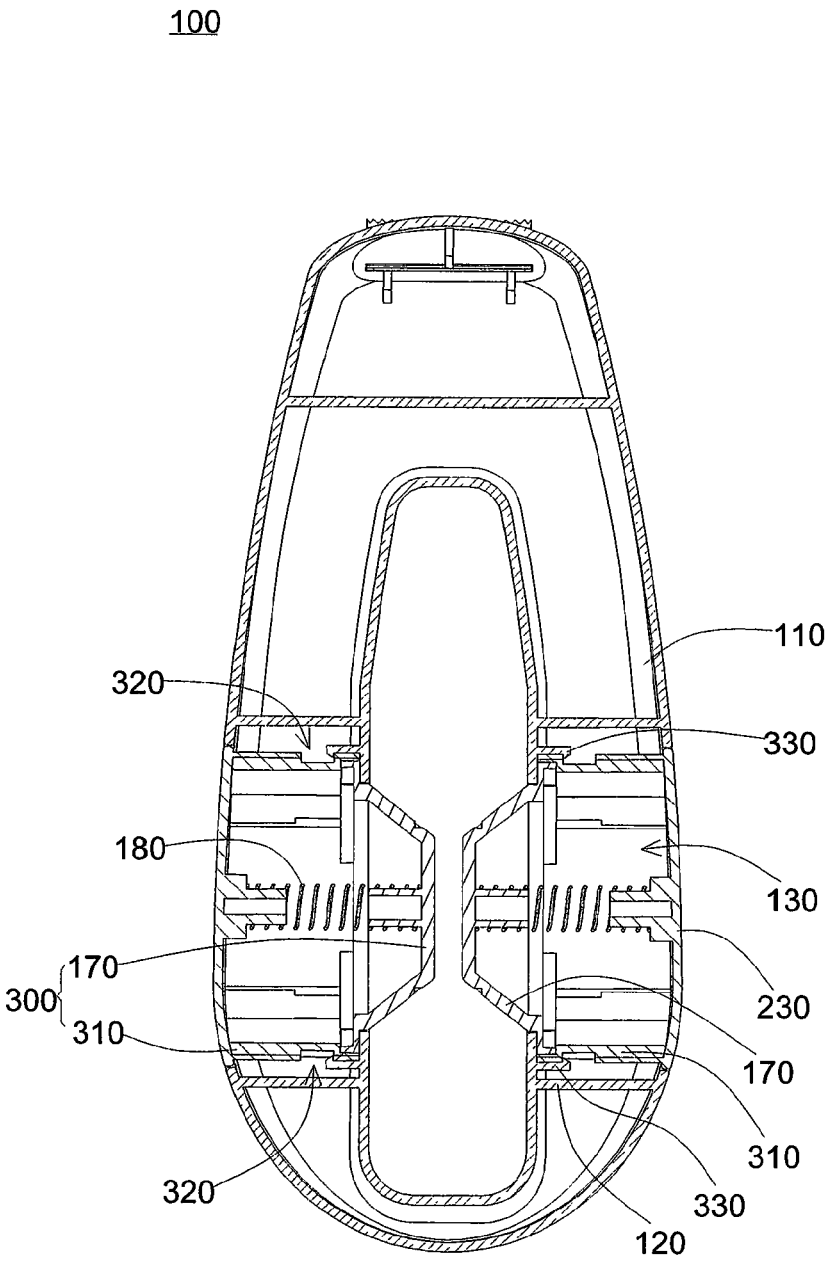
FIG. 9 shows another embodiment of the tape cutting dispenser of the present invention.

FIG. 8*a*, FIG. 8*b* and FIG. 9 show another preferable embodiment of the present invention. In the present embodiment, the holder 170 may also be replaced by a holder module 300. The holder module 300, which includes a holder 170 and the fastening sleeve 310, is disposed in the hole 130. The holder 170 is axially moveable along the fastening sleeve 310. In the embodiment shown in FIG. 8*a* and FIG. 8*b*, a pair of the guiding portions 182 are disposed on the rim of the flange 184 of the holder 170 while the inner wall of the fastening sleeve 310 has two second guiding groove 340, thereby the guiding portion 182 can be moved axially along the second guiding grooves 340. In particular, the dimension of the second guiding groove 340 is preferably greater than the width of the guiding portion 182, such that the guiding portion 182 can be bent away from the axial direction A with appropriate ranges/angles. The shape of the guiding portion 182 is preferably an arc shape so as to move smoothly at the second guiding portion 340.

Furthermore, in the present embodiment, the limiting portion 126 is preferably disposed on the fastening sleeve 310 which is corresponding to the rim of the cover 230 for engaging with the flange 184 of the holder 170. One side of the fastening sleeve 310 and the cover 230 are preferably integrately formed to cover the outside surface of the hole 130Of the wall 120. The side wall of the fastening sleeve 310 further forms at least one opening 320 while the wall 120 near the hole 130 has at least one hook 330 engaging with the opening 320. Therefore, the holder module 300 can be engaged with the opening 320 of the fastening sleeve 310 to position in the hole 130 by the hook 330. The relative structure of the holder 170 and the relative assembling steps about the tape 700 assembling with the tape cutting dispenser 100 please refer to the above-mentioned embodiments.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A tape cutting dispenser, comprising:

a body having two opposite walls, each of the walls having a hole, wherein an accommodating space is formed between the walls;

a pair of holders disposed in each of the holes, wherein the holder has a protruding portion protruding toward the opposite wall along an axial direction, the holder further has an elastic element having axial flexibility and the elasticity bending away from the axial direction, such that the protruding portion of the holder is recoverably bendable away from the axial direction, wherein the holder has at least one guiding portion extending out of a rim of the holder while the wall has at least one axially extending guiding groove to receive the guiding portion; and a cutting device disposed on the body opposite to the accommodating space.

2. The tape cutting dispenser of claim 1 further includes at least one cover covering an outside surface of the hole of the wall.

3. The tape cutting dispenser of claim 2, wherein the cover has at least one female connecting portion while the wall has a male connecting portion engages with the female connecting portion.

4. The tape cutting dispenser of claim 2, wherein a first positioning pillar is disposed inside the holder, one end of the elastic element engages with the first positioning pillar and the other end of the elastic element contacts with an inner surface of the cover.

5. The tape cutting dispenser of claim 4, wherein the inner surface of the cover further has a second positioning pillar which is corresponding to the first positioning pillar.

6. The tape cutting dispenser of claim 1, wherein the protruding portion includes a cone casing, a top surface and a flange, the top surface is disposed on the top end of the cone casing, and the flange is disposed on the bottom end of the cone casing.

7. The tape cutting dispenser of claim 6, wherein the wall includes a limiting portion corresponding to the flange so as to limit the axial movement of the holder.

8. The tape cutting dispenser of claim 6, wherein the surface of the protruding portion has a plurality of dents, the plurality of dents are disposed on a surface parallel to the top surface.

9. A tape cutting dispenser, comprising:

a body having two opposite walls, each of the walls having a hole, wherein an accommodating space is formed between the walls;

a pair of holder modules disposed in each of the holes, wherein the holder module has a protruding portion protruding toward the opposite wall along an axial direction, the holder module further has an elastic element having axial flexibility and the elasticity bending away from the axial direction, such that the protruding portion of the holder module is recoverably bendable away from the axial direction, the holder module further includes a holder and a fastening sleeve, the holder is axially moveable along the fastening sleeve, wherein the fastening sleeve includes at least one axially extending second guiding groove while the holder includes at least one guiding portion axially moving along the second guiding groove; and a cutting device disposed on the body opposite to the accommodating space.

10. The tape cutting dispenser of claim 9, wherein the protruding portion is formed on one side of the holder, the protruding portion includes a cone casing, a top surface and a flange, the top surface is disposed on the top end of the cone casing, and the flange is disposed on the bottom end of the cone casing.

11. The tape cutting dispenser of claim 10, wherein a sidewall is disposed between the cone casing and the flange and is around the axial direction, the depth of the sidewall is smaller than a stroke of the elastic element.

12. The tape cutting dispenser of claim 11, wherein the width of the second guiding groove is greater than the width of the guiding portion, such that the holder bends appropriate angles.

13. The tape cutting dispenser of claim 9, wherein a side wall of the fastening sleeve further includes an aperture while the wall has at least one hook engaging with the aperture.

14. The tape cutting dispenser of claim 9, wherein at least one guiding groove is formed aside the hole, and the second guiding groove is corresponding to the guiding portion, the width of the second guiding groove is greater than the width of the guiding portion, such that the holder bends appropriate angles.

* * * * *